US006247304B1

(12) United States Patent
Kim et al.

(10) Patent No.: US 6,247,304 B1
(45) Date of Patent: Jun. 19, 2001

(54) COUPLING MECHANISM BETWEEN EXHAUST PIPE AND CATALYTIC CONVERTER

(75) Inventors: Han-Sang Kim, Yongin; Sang-Bong Park, Seoul, both of (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/469,950

(22) Filed: Dec. 21, 1999

(30) Foreign Application Priority Data

Oct. 5, 1999 (KR) ..... 99-16546

(51) Int. Cl.[7] ..... F01N 3/10
(52) U.S. Cl. ..... 60/299; 60/324
(58) Field of Search ..... 60/299, 302, 272, 60/282, 323, 321, 324

(56) References Cited

U.S. PATENT DOCUMENTS 3,989,471 * 11/1976 Nowak ..... 60/299
4,420,933 * 12/1983 Kajitani et al. ..... 60/302
5,031,401 * 7/1991 Hinderks ..... 60/302
5,103,641 * 4/1992 Maus et al. ..... 60/299
5,144,797 * 9/1992 Swars ..... 60/299
5,150,573 * 9/1992 Maus et al. ..... 60/299
5,248,859 * 9/1993 Boria ..... 181/238
5,438,830 * 8/1995 Matsumura ..... 60/302
5,996,339 * 12/1999 Gottberg et al. ..... 60/299

FOREIGN PATENT DOCUMENTS

2305818 * 8/1974 (DE) ..... 60/302
2804428 * 8/1979 (DE) ..... 60/324
2913731 * 10/1979 (DE) ..... 60/302
0168015 * 10/1982 (JP) ..... 60/302
0210117 * 12/1982 (JP) ..... 60/302
0107811 * 6/1983 (JP) ..... 60/302

* cited by examiner

*Primary Examiner*—Thomas Denion
*Assistant Examiner*—Diem Tran
(74) *Attorney, Agent, or Firm*—Christie, Parker & Hale, LLP

(57) ABSTRACT

An automotive exhaust system includes an exhaust manifold, an exhaust pipe, and a catalytic converter connected at its upstream end to the exhaust manifold by an inlet connector and at its downstream end to the exhaust pipe by an outlet connector. The outlet connector is cone-shaped having a spiral outline.

2 Claims, 4 Drawing Sheets

COUPLING MECHANISM BETWEEN EXHAUST PIPE AND CATALYTIC CONVERTER

FIELD OF THE INVENTION

The present invention relates to an engine exhaust system and, more particularly, to a coupling mechanism between an exhaust pipe and a catalytic converter of the engine exhaust system.

BACKGROUND OF THE INVENTION

FIGS. 7 and 8 show a conventional exhaust system including a close-coupled catalytic converter.

A catalytic converter 52 is connected at its upstream end to an exhaust manifold 51 by an inlet connector 53 and at its downstream end to an exhaust pipe 56 by an outlet connector 54.

The inlet connector 53 is coupled at its first end to a mixing pipe 55 extending from the exhaust manifold 51 and at its second end to an inlet of the converter 52.

The outlet connector 54 is coupled at its one end to the exhaust pipe 56 and at its other end to the catalytic converter 52. The outlet connector 54 is bent at about 80 degrees with respect to a central axis C of the catalytic converter 52. In addition, the bent portion of the outlet connector 54 is designed such that a central axis D thereof intersects the central axis C of the catalytic converter 52 to increase the degree of free layout of an engine.

However, in the above described conventional exhaust system, since the diameter is of the outlet connector 54 at a portion of the same connected to the exhaust pipe 56 abruptly decreases for suitable connection with the exhaust pipe 56, pressure passing through the catalytic converter 52 is rapidly reduced at the portion where the diameter of the outlet connector 54 is reduced. This deteriorates overall engine performance since backpressure is increased.

SUMMARY OF THE INVENTION

The present invention has been made in an effort to solve the above-described problems.

It is an objective of the present invention to provide an exhaust system that can improve engine performance by preventing backpressure from being increased.

To achieve the above objective, the present invention provides an automotive exhaust system comprising an exhaust manifold, an exhaust pipe, and a catalytic converter connected at its upstream end to the exhaust manifold by an inlet connector and at its downstream end to the exhaust pipe by an outlet connector, wherein the outlet connector is cone-shaped having a spiral outline.

The outlet connector is, when viewed from a front side, curved by 55–65 degree with respect to an x-axis which is a central longitudinal axis of the catalytic converter, and when viewed from a plane view, curved by 40–55 degrees with respect to a z-axis.

The outlet connector has an ellipse-shaped opening on an end connected to the catalytic converter and on an end connected to the exhaust pipe.

BRIEF DESCRIPTION OF THE DRAWINGS

The accompanying drawings, which are incorporated in and constitute a part of the specification, illustrate an embodiment of the present invention, and, together with the description, serve to explain the principles of the invention.

DETAILED DESCRIPTION OF THE PREFERRED EMBODIMENTS

Reference will now be made in detail to the present preferred embodiment of the invention, an example of which is illustrated in the accompanying drawings.

Figure 1:
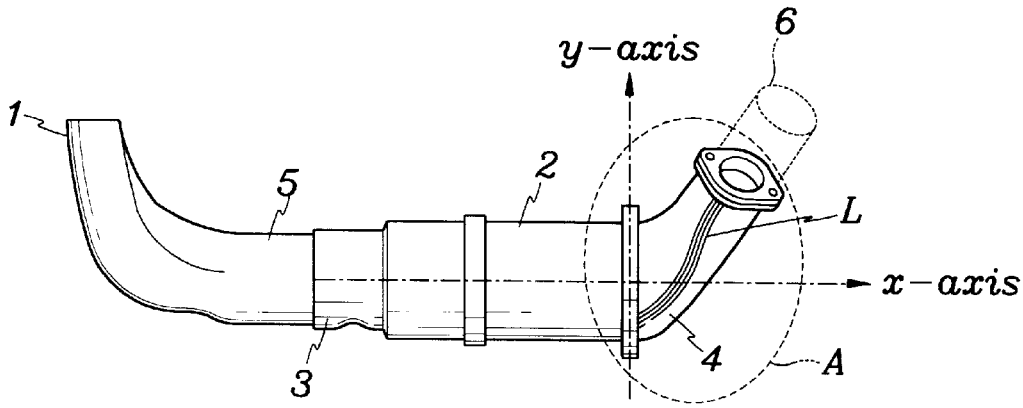
FIG. 1 is a front view of an exhaust system of a preferred embodiment of the present invention.
Figure 2:
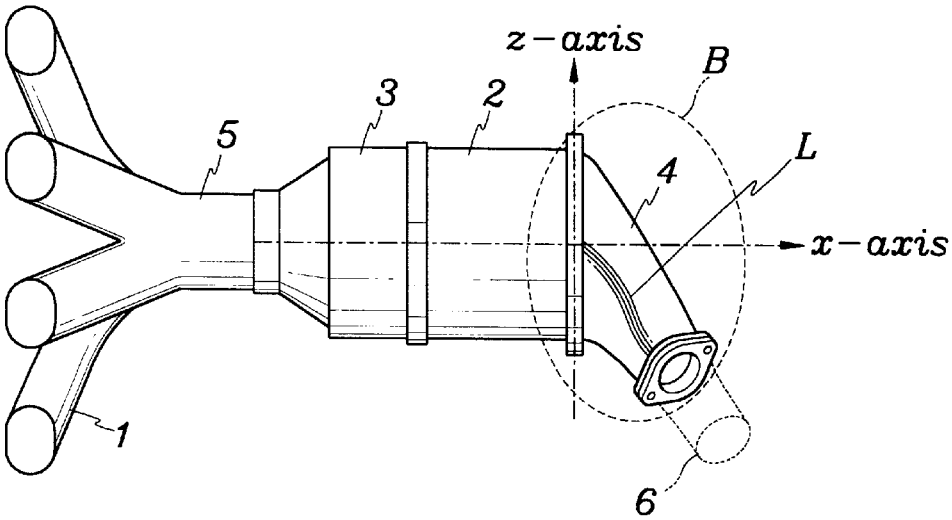
FIG. 2 is a plane view of the exhaust system depicted in FIG. 1.

FIGS. 1 and 2 show an exhaust system for an automotive engine according to a preferred embodiment of the present invention.

A catalytic converter 2 is connected at its upstream end to an exhaust manifold 1 by an inlet connector 3 and at its downstream end to an exhaust pipe 6 by an outlet connector 4.

The inlet connector 3 is coupled at its first end to a mixing pipe 5 extending from the exhaust manifold 1 and at its second end to an inlet of the catalytic converter 2.

According to a feature of the present invention, the outlet connector 4 is designed to increase a sectional area through which exhaust gases flow.

That is, as shown in FIGS. 1 and 2, the outlet connector 4 is cone-shaped having a spiral outline L.

Figure 3:
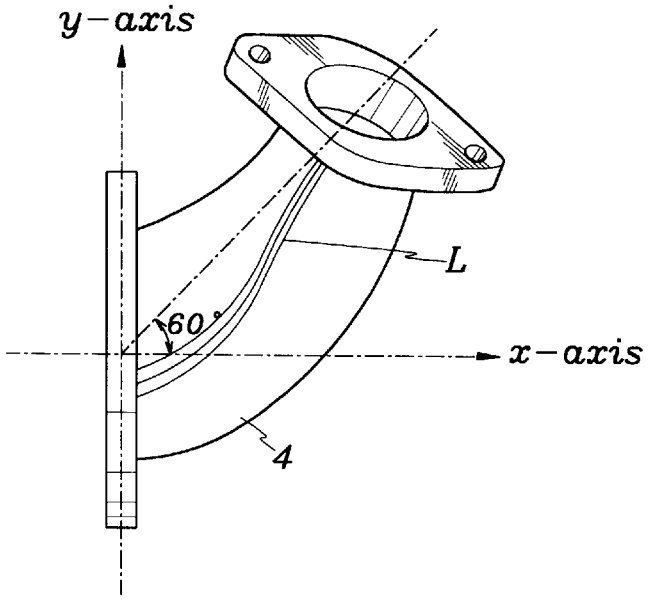
FIG. 3 is an enlarged view of a portion A of FIG. 1.
Figure 4:
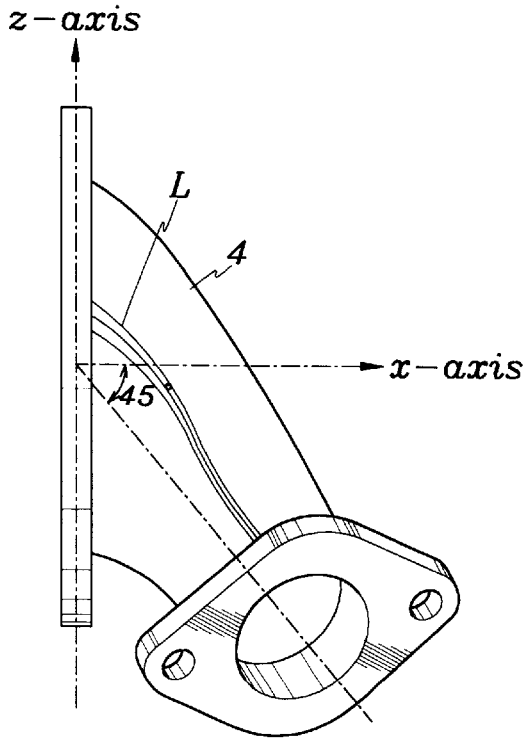
FIG. 4 is an enlarged view of a portion B of FIG. 2.

Describing more in detail, the outlet connector 4 is, when viewed from a front side (see FIG. 3), the outlet connector 4 is curved 60 degrees with respect to an x-axis, or a central longitudinal axis of the converter 2. On the other hand, when viewed from a plane view (see FIG. 4), the outlet connector 4 is curved 45 degrees with respect to a z-axis and the x-axis.

Figure 5:
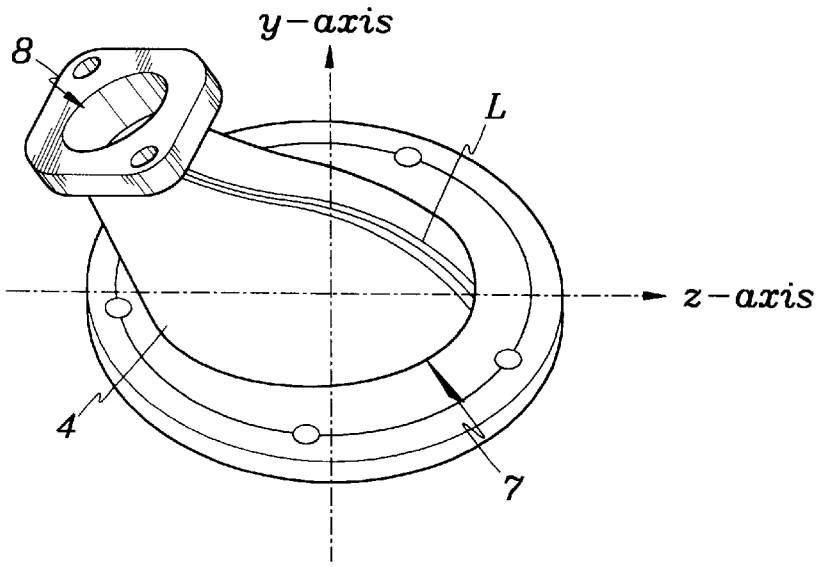
FIG. 5 is a side view of FIG. 3.

In addition, as shown in FIG. 5, a first end of the outlet connector 4 has an ellipse-shaped opening 7, while a second end of the outlet connector 4 has a circular-shaped opening 8. The spiral design of the outlet connector 4 prevents the effective sectional flowing area from being abruptly reduced and allows the exhaust gases to spirally flow through the outlet connector 4.

With such a configuration, an abrupt increase of exhaust backpressure caused by sharp reductions in the sectional flowing area of the outlet connector 4 can be prevented.

Figure 6:
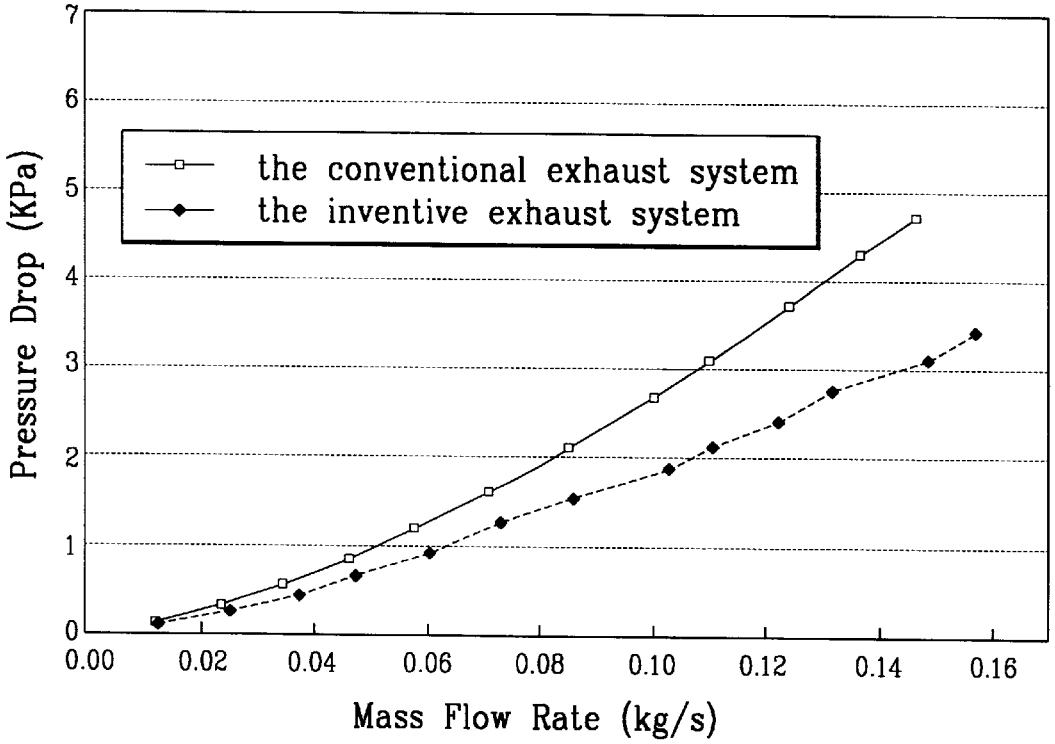
FIG. 6 is a graph illustrating pressure drops of the present invention and conventional art.
Figure 7:
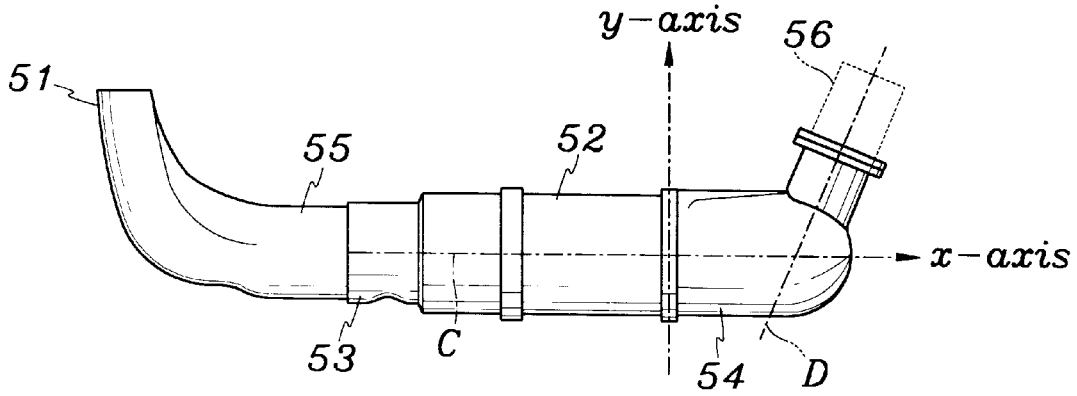
FIG. 7 (Prior Art)
FIG. 7 is a front view of a conventional exhaust system.
Figure 8:
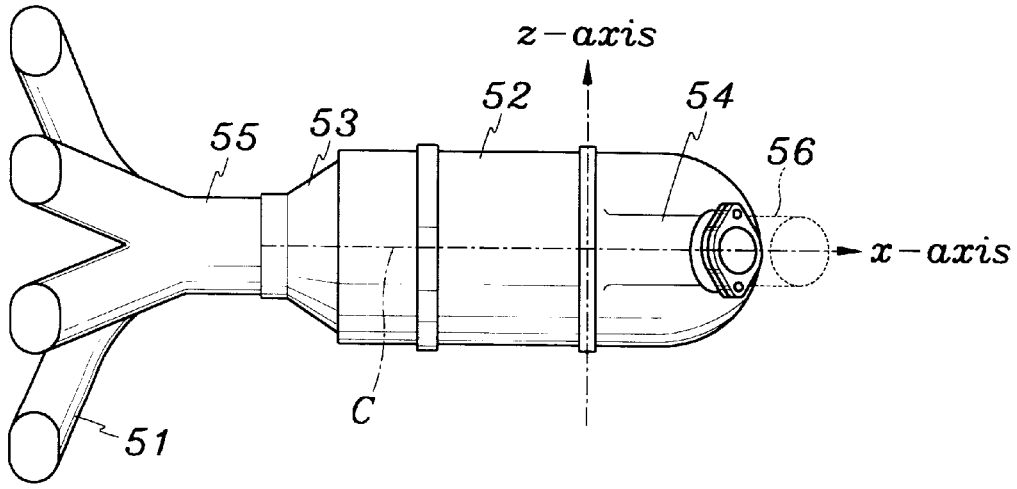
FIG. 8 (Prior Art)
FIG. 8 is a plane view of the conventional exhaust system depicted in FIG. 7.

FIG. 6 shows a graph illustrating data on pressure drops of the conventional exhaust system and the inventive exhaust system.

As shown in the graph, when the maximum amount of exhaust flow is introduced into the exhaust systems, a greater drop in pressure of the exhaust system of the present invention of about 33% compared to the conventional exhaust system is realized. This shows that the inventive exhaust system reduces exhaust backpressure when the engine is operating, improving overall performance of the engine, and in particular full throttle performance.

In addition, the spiral design of the outlet connector 4 minimizes the interference to the flow of the exhaust gases through the outlet connector 4. That is, the outlet connector 4 enables the free flow of exhaust gases therethrough. Furthermore, the spiral design allows a flow impact surface of the outlet connector 4 to be evenly distributed, preventing localized damage of the outlet connector 4.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An automotive exhaust system comprising:

an exhaust manifold;

an exhaust pipe;

a catalytic converter connected at its upstream end to the exhaust manifold by an inlet connector and at its downstream end to the exhaust pipe by an outlet connector;

the outlet connector being cone-shaped and having a spiral outline, the connector further having an elliptical opening on an end connected to the catalytic converter, wherein the outlet connector is, when viewed from a front side, curved by about 55 to about 65 degrees with respect to an x-axis which is a central longitudinal axis of the catalytic converter, and when viewed from a plane view, curved by about 40 to about 55 degrees with respect to a z-axis.

2. The automotive exhaust system of claim 1, wherein the outlet connector has an elliptical opening on an end connected to the exhaust pipe.

* * * * *

UNITED STATES PATENT AND TRADEMARK OFFICE

CERTIFICATE OF CORRECTION

PATENT NO. : 6,247,304 B1 
DATED : June 19, 2001
INVENTOR(S) : Han-Sang Kim and Sang-Bong Park It is certified that error appears in the above-identified patent and that said Letters Patent is hereby corrected as shown below:

Title page,
Item [30], Foreign Application Priority Data should read:
-- May 10, 1999 (KR) …….. 99-16546 --.

Signed and Sealed this

Fourteenth Day of January, 2003

JAMES E. ROGAN
*Director of the United States Patent and Trademark Office*